US011710605B2

(12) United States Patent
Iwasaka et al.

(10) Patent No.: US 11,710,605 B2
(45) Date of Patent: Jul. 25, 2023

(54) POWER RELAY HAVING TERMINAL TABS

(71) Applicant: OMRON Corporation, Kyoto (JP)

(72) Inventors: Hiroyuki Iwasaka, Kyoto (JP); Kazuki Furukawa, Kyoto (JP); Shinichi Ogawa, Kyoto (JP); Hiroyuki Harimochi, Kyoto (JP); Ayata Horie, Kyoto (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/588,340

(22) Filed: Jan. 31, 2022

(65) Prior Publication Data

US 2022/0246365 A1 Aug. 4, 2022

(30) Foreign Application Priority Data

Feb. 3, 2021 (JP) ..... 2021-015948

(51) Int. Cl.
*H01H 1/14* (2006.01)
*H01H 9/02* (2006.01)

(52) U.S. Cl.
CPC ..... *H01H 1/14* (2013.01); *H01H 9/02* (2013.01)

(58) Field of Classification Search
CPC ..... H01H 1/14; H01H 45/00; H01H 9/02; H01H 51/22; H01H 45/10; H01H 9/30; H01R 13/502
USPC ..... 200/239
See application file for complete search history.

(56) References Cited

U.S. PATENT DOCUMENTS 2,634,312 A * 4/1953 Batchellerhughw ..... F24C 7/08 439/849
4,246,437 A * 1/1981 Frey ..... H05K 5/0095 264/261
4,758,809 A * 7/1988 Bell ..... H01H 50/28 335/85
6,320,485 B1 * 11/2001 Gruner ..... H01H 51/2209 335/185
9,007,153 B2 * 4/2015 Weeks ..... H01H 83/04 335/18

(Continued)

FOREIGN PATENT DOCUMENTS

JP 2019-117810 A 7/2019
JP 2020-174006 A 10/2020

*Primary Examiner* — Edwin A. Leon
*Assistant Examiner* — Iman Malakooti
(74) *Attorney, Agent, or Firm* — Shinjyu Global IP

(57) ABSTRACT

A power relay having terminal tabs includes an on-off contact element having at least one movable contact and at least one stationary contact, an on-off drive element, at least two pairs of input/output terminal tabs, and at least one pair of control terminal tabs. The on-off drive element makes the movable contact come into contact with or separated from the stationary contact. The two pairs of input/output terminal tabs are electrically connected to at least one pair of input/output portions of the on-off contact element. The one pair of control terminal tabs is electrically connected to control terminal portions of the on/off drive element. Each of the input/output portions is electrically connected to two of the input/output terminal tabs, which are arranged side-by-side in their thickness direction and in vicinity with each other. The input/output terminal tabs and the control terminal tabs have a same thickness and width.

6 Claims, 5 Drawing Sheets

(56) References Cited

U.S. PATENT DOCUMENTS

| | | | | |
|---|---|---|---|---|
| 9,076,617 | B2 * | 7/2015 | Yamashita | H01H 9/40 |
| 10,515,774 | B2 * | 12/2019 | Sunohara | H01H 50/24 |
| 2002/0109569 | A1 * | 8/2002 | Yamashita | H01H 50/443 335/129 |

* cited by examiner

POWER RELAY HAVING TERMINAL TABS

CROSS-REFERENCE TO RELATED APPLICATION

This application claims priority to Japanese Patent Application No. 2021-015948, filed Feb. 3, 2021. The contents of that application are incorporated by reference herein in their entirety.

FIELD

The present invention relates to a power relay having terminal tabs as input/output terminals. In particular, it relates to a high-capacity (for example, 100 V or more and 10 A or more) power relay used for: quick charging of electric vehicles, various power storage systems, elevators, industrial robots, and the like.

BACKGROUND

Terminal tabs (IEC60760 Flat, quick-connect terminations) realize electrical connection by being inserted into receptacles (connectors) at the tip of electric cables or sockets. High-capacity power relays having terminal tabs are used, for example, in electric and non-electric vehicles, where the terminal tabs are basically compliant with ISO TS 16949 standards.

The terminal arrangement of such a high-capacity power relay is, in general, of 4 poles (SPST; 1a) or 5 poles (SPDT; 1c). Two of these terminals are control-circuit terminals (coil terminals), and the rest are for power input/output. For example, JP2019-117810A and JP2020-174006A show examples of such 4-pole power relay.

When to cope with further increase of the capacity, it is necessary to increase cross-sectional areas of the terminal tabs of the power relay by increasing the width and thickness of the terminal tabs This is because: when the current increases, the amount of heat generated increases by the square of the current, and thus, in order to ensure the reliability of the terminal tab connection, it is necessary to decrease the resistance of the terminal connection elements and decrease the heat generation.

However, in that case, the product size may increase due to the increase in the terminal sizes.

SUMMARY

A power relay having terminal tabs according to one aspect of the present disclosure includes: (1) an on-off contact element having at least one movable contact and at least one stationary contact; (2) an on-off drive element, which makes the movable contact come into contact with and away from the respective stationary contact; (3) at least two pairs of input/output terminal tabs electrically connected to (or integrally formed with) at least one pair of input/output portions of the on-off contact element; and (4) at least one pair of control terminal tabs that are electrically connected to (or integrally formed with) control terminal portions of the on-off drive element, and (5) each of the input/output portions being electrically connected to (or integrally formed with) two of the input/output terminal tabs, which are arranged side-by-side in their thickness direction and in vicinity with each other; and (6) the input/output terminal tabs and the control terminal tabs having the same or same level of thickness and width, with each other.

Here, the same level may be meant to indicate that even if there is a difference between two dimensions, the difference based on the smaller dimension is 20% or less, 15% or less, 10% or less, or 5% or less.

According to another aspect of the present disclosure, each of the input/output portions as well as the two input/output terminal tabs electrically connected thereto are formed by a single U-shaped terminal member that is obtainable by bending a single metal piece. Further, preferably, a portion of the U-shaped terminal member forms the stationary contact.

According to another aspect of the present disclosure, the rated current is greater than 30 A, e.g. 35-100 A; and each of the input/output terminal tab has a thickness of 1 mm or less, e.g. 0.5-0.9 mm, and a width of 7 mm or less, e.g. 5 to 7 mm.

According to another aspect of the present disclosure, the on/off drive element includes a plunger, which has at its actuation end, a conductive movable terminal element having two of the movable contacts; and thus, the two pairs of the input/output terminal tabs are electrically connected to each other at a time the movable contact touches the respective stationary contact.

According to the present disclosure, at least one among advantageous effects (i) to (ii) below is obtained.

(i) It is able to install the terminal tabs in a small space so as to downsize the power-relay product.

(ii) Stable energization with a large capacity is enabled.

DETAILED DESCRIPTION

The power relay of the embodiment of the present invention will be described with reference to FIGS. 1 and 2.

Figure 1:
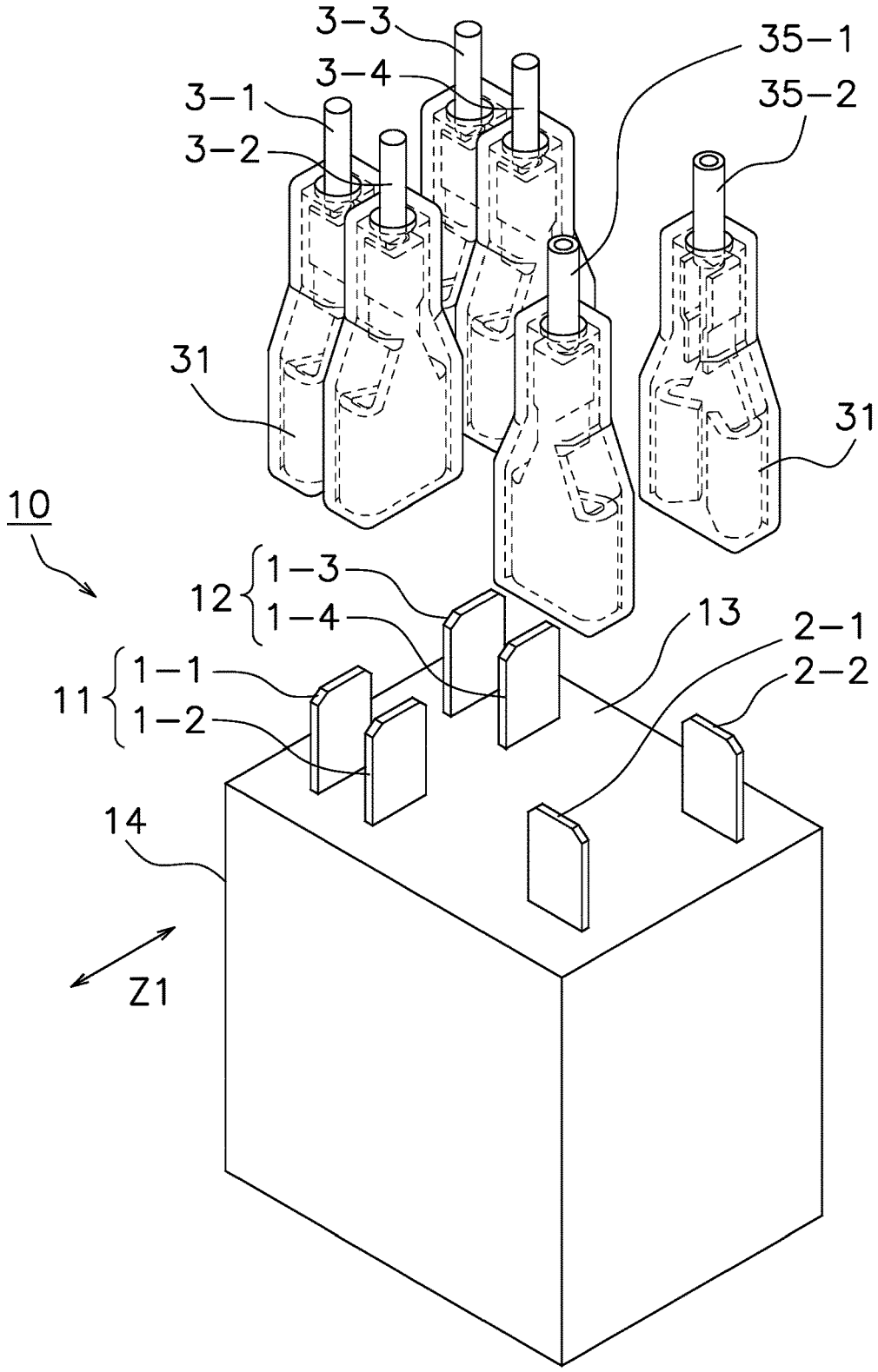
FIG. 1 is an external perspective view showing a power relay according to an embodiment, and terminal tabs thereof, as well as electric cables with receptacles, which are connected to the power relay.
Figure 3:
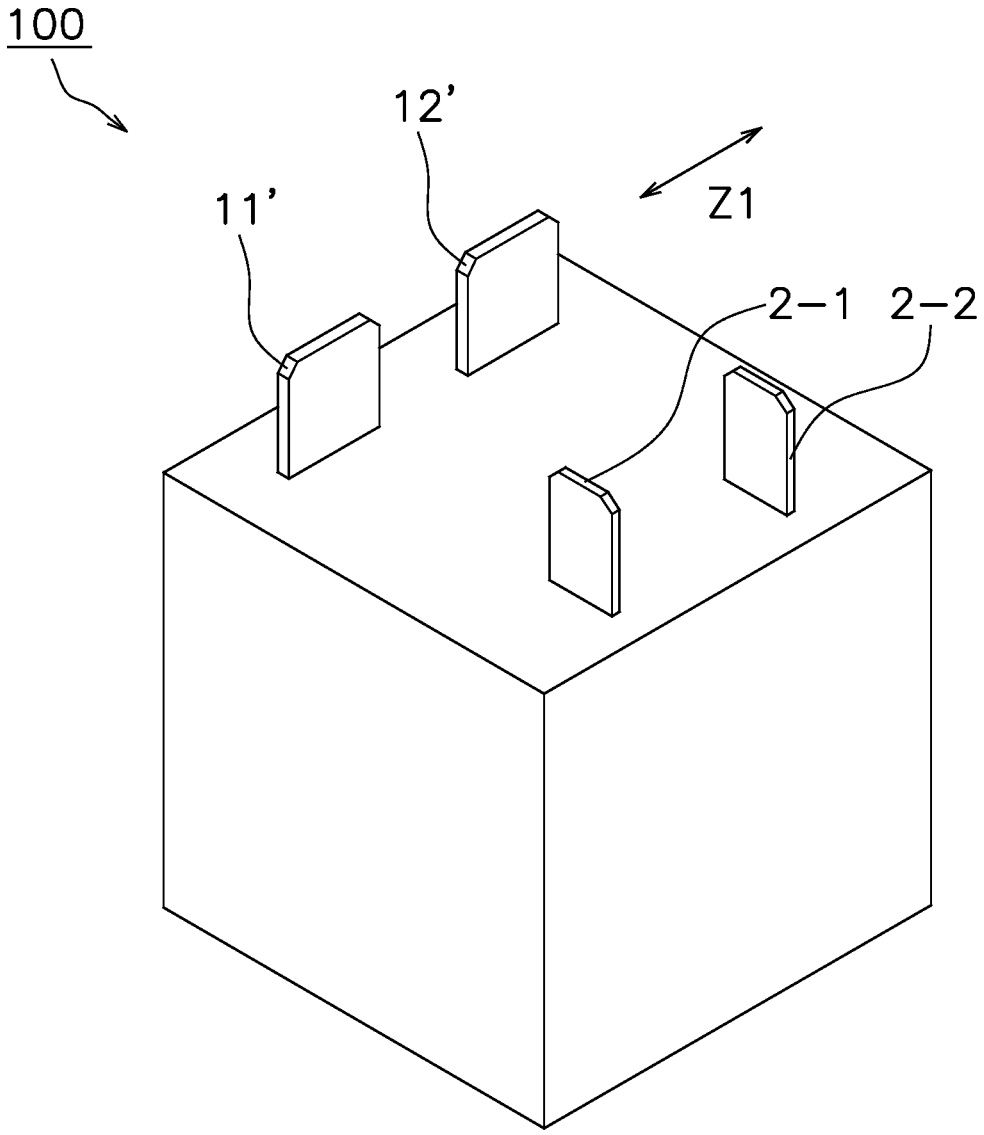
FIG. 3 is an external perspective view similar to FIG. 1, showing a typical one of conventional power relays and its terminal tabs.
Figure 4A:
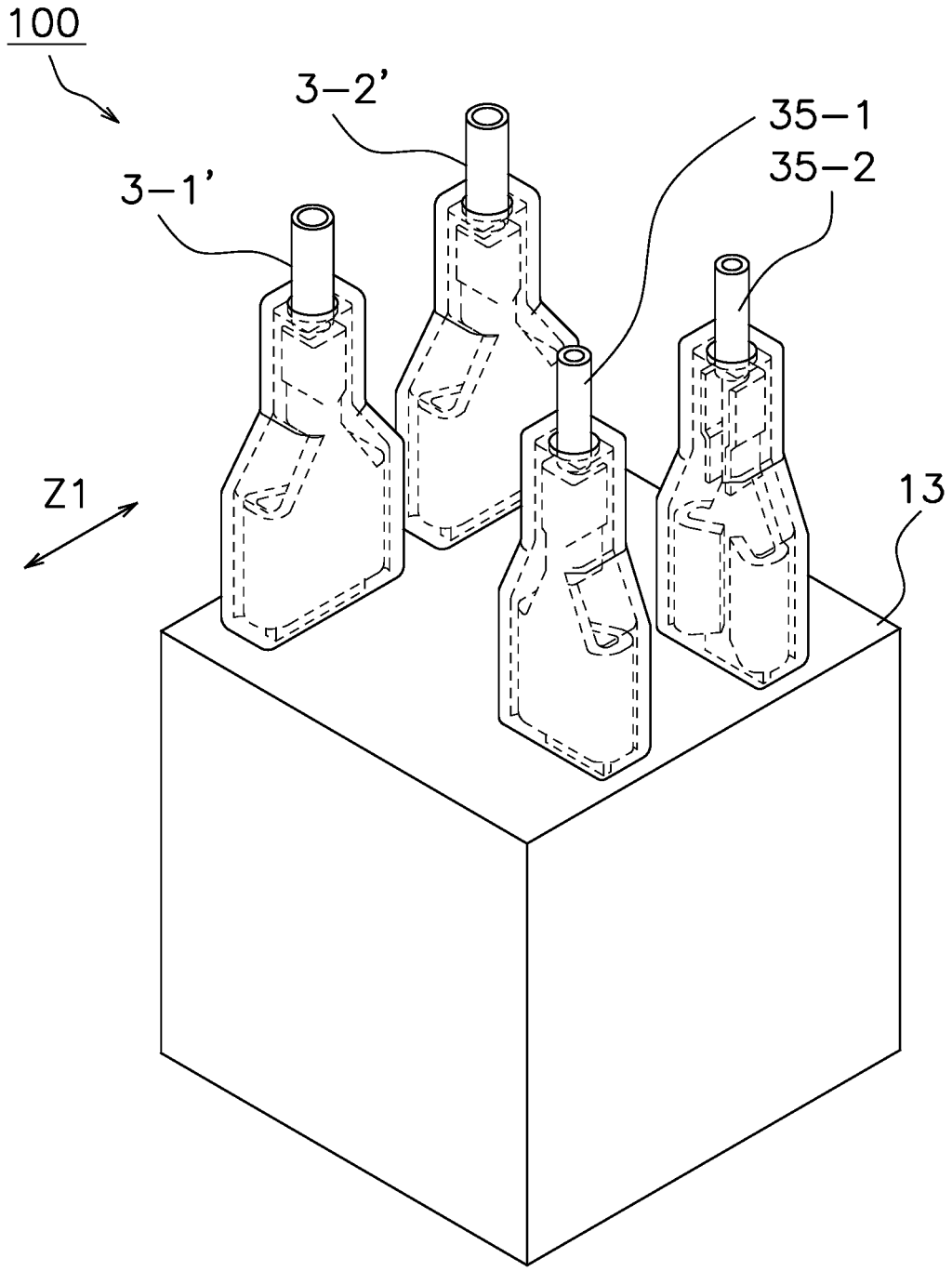
FIG. 4 is a pair of external perspective views, showing the power relay of the prior art of FIG. 3 and the power relay of the embodiment of FIG. 1, in contrast with each other, in a state where electric cables are connected to the power relay.
Figure 4B:
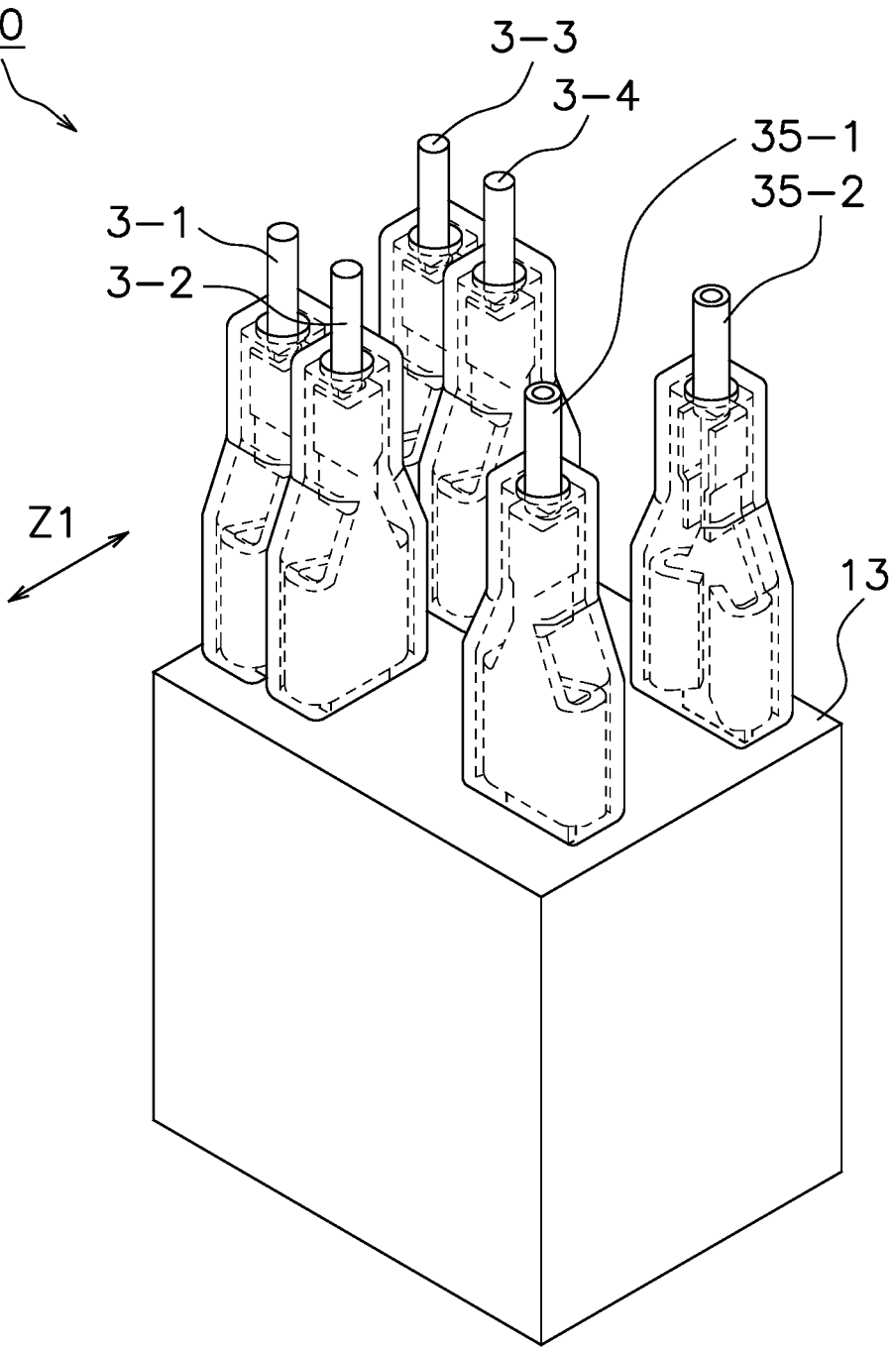

FIG. 1 is an external perspective view showing a power relay of an embodiment, and terminal tabs thereof, as well as electric cables with receptacles connected to the power relay. FIG. 2 is a perspective view of a main part of the power relay, showing in particular a pair of U-shaped terminal members and their vicinity. It should be noted that, in FIG. 2, the shape of the terminal tabs is modified from that in FIG. 1. FIG. 3 is an external perspective view similar to FIG. 1, showing a typical one of conventional power relays and its terminal tabs. FIG. 4 is a pair of external perspective views, showing the power relay of the prior art of FIG. 3 and the power relay of the embodiment of FIG. 1, in contrast with each other, in a state where electric cables are connected to the power relay.

The terminal-connection face 13 (upper face in the figures) of the power relay 10 is provided with four input/output terminal tabs 1-1 to 1-4 and two control terminal tabs 2-1 to 2-2. For convenience of explanation, upper-left side of the figures is taken as left side and lower-right side is taken as the right side. Then, the input/output terminal tabs 1-1 to 1-4 are arranged close to the left fringe of the rectangular terminal-connection face. The control terminal tabs 2-1 to 2-2 are arranged close to the right fringe of the surface. With respect to the input/output terminal tabs 1-1 to 1-4, each terminal tab extends in a direction along the right fringe, that is, in front-rear direction Z1. The control terminal tabs 2-1 to 2-2 have tab faces extending in a direction along the front and rear fringes of the terminal-connection face, that is, in left-right direction. Here, front and rear, left and right, and upper and lower sides are irrelevant to the arrangement at the time of actual use.

Each two of the first to fourth input/output terminal tabs 1-1 to 1-4 are arranged close to each other in the thickness direction of the terminal tabs. That is, the first and second input/output terminal tabs 1-1 to 1-2 are arranged close to each other in the thickness direction of their terminal tabs to form a first input/output terminal element 11. And, the third and fourth input/output terminal tabs 1-3 to 1-4 are arranged close to each other in the thickness direction of their terminal tabs to form a second input/output terminal element 12. The first input/output terminal element 11 and the second input/output terminal element 12 are arranged in the front-rear direction Z1 along the left fringe of the terminal-connection face 13.

The first and second input/output terminal tabs 1-1 to 1-2, which form the first input/output terminal element 11, are electrically connected to each other inside the casing 14 of the power relay 10. In the same manner, the third and fourth input/output terminal tabs 1-3 to 1-4, which form the second input/output terminal element 12, are electrically connected to each other inside the casing 14 of the power relay 10. That is, in each of two pairs of input/output terminal tabs 1-1/1-2 and 1-3/1-4, the input/output terminal tabs 1 in a pair, which are close to each other in the thickness direction of the terminal tabs, are connected to each other. In other words, among the four input/output terminal tabs 1-1 to 1-4, each two terminal tabs 1-1 and 1-2/1-3 and 1-4 are connected to each other so as to form the first and second input/output terminal elements 11 and 12.

Four input/output electric cables 3-1 to 3-4 are respectively connected to the four input/output terminal tabs 1-1 to 1-4, by the receptacle 31 at the tip of the electric cables. Each of the receptacles 31 is covered with an insulating resin cover 32.

As shown in FIG. 1, each two, in the pair, of the input/output terminal tabs 1-1 and 1-2/1-3 and 1-4, which respectively form the first input/output terminal element 11 and the second input/output terminal element 12, are distanced with each other by a gap that enables arranging of receptacle 31 and the resin covers 32. This gap may be in an extent such that arranging is just enabled or is made with some play.

Figure 2:
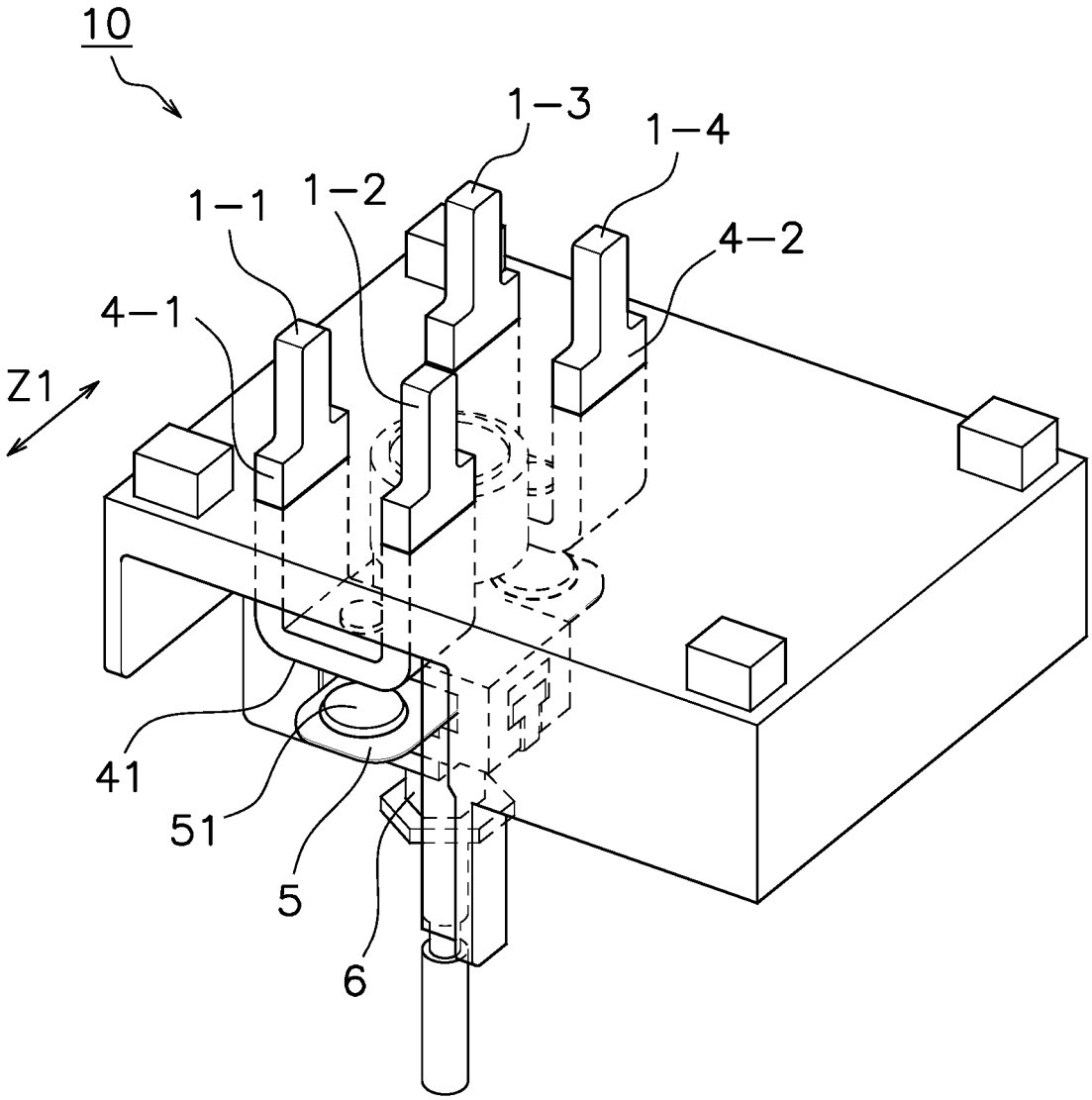
FIG. 2 is a perspective view of a main part of the power relay, showing a pair of U-shaped terminal members and their vicinity.

As shown in FIG. 2, each two, in the pair, of the input/output terminal tabs 1-1 and 1-2/1-3 and 1-4 are formed by one U-shaped terminal member 4-1/4-2. Each of the U-shaped terminal members 4-1/4-2 is formed by bending one strip-shaped metal plate into a U-shape. In FIG. 2, each of the input/output terminal tabs 1 is illustrated as having smaller width on the tip side, but in a high-capacity power relay, the shape shown in FIG. 1 would be more preferable.

Further, as shown in FIG. 2, each of the two U-shaped terminal members 4-1 to 4-2, which are arranged side-by-side in the front-rear direction Z1, has the stationary contact 41 at bottom face of such U-shaped member, which faces inward of the power relay 10. The two stationary contacts 41, which are arranged side-by-side in the front-rear direction Z1, are arranged as respectively opposite to two movable contacts 51 at below. The two movable contacts 51, which are arranged side-by-side in the front-rear direction Z1, are formed on upper faces of two end-portions of movable contact element 5, which is formed by a single metal board or strip elongated in the front-rear direction Z1. The movable contact element 5 is driven upward and downward by a plunger 6 so as to induce on/off motion of the electrical contact.

As shown in FIG. 2, the two U-shaped terminal members 4-1 to 4-2 are identical in shape and size, with each other. Further, as specifically shown in FIG. 1, the first to fourth input/output terminal tabs 1-1 to 1-4 are identical in shape and size, with each other and with the two control terminal tabs 2-1 and 2-2.

Consequently, as shown in FIG. 1, the receptacles 31, which are identical in shape and size, are adoptable in both of: the input/output electric cables 3-1 to 3-4 being connected to the input/output terminal tabs 1-1 to 1-4; and the control electric cables 35-1 to 35-2 being connected to the control terminal tabs 2-1 to 2-1. Therefore, crimping for terminal connection, and soldering when necessary, would be efficiently achieved by an identical process for each of the terminal tabs 1 and 2.

In a specific example, each of the terminal tabs 1 and 2 in the power relay 10 of the embodiment has a width of 6.3 mm, a thickness of 0.8 mm, and a cross-sectional area of 5.04 $mm^2$, and is able to cope with a rated current of 30 A. Therefore, each of the input/output terminal elements 11 to 12, which has two, in tandem and in the pair, of the input/output terminal tabs 1-1 and 1-2/1-3 and 1-4 is able to cope with the rated current of 60 A. Further, the gap or tandem interval between two, in the pair, of the input/output terminal tabs 1 may be narrowed to a minimum of 6.5 mm.

FIG. 3 shows a conventional power relay 100 having the same capacity (rated control capacity=rated energization current×rated energization voltage) as the power relay 10 of the embodiment of FIG. 1. The control terminal tabs 2-1 to 2-2 in FIG. 3 are identical with those in the embodiment of FIG. 1.

In the conventional power relay 100, each input/output terminal element is composed of a single input/output terminal tab 11' or 12'. The dimensions of such single input/output terminal tab 11' or 12' are larger than those of the control terminal tabs 2-1 to 2-2. In a specific example, each of the input/output terminal tabs 11' and 12' in the conventional power relay 100 has a width of 9.5 mm, a thickness of 1.2 mm, and a cross-sectional area of 11.4 $mm^2$ so as to cope with a rated current of 60 A.

FIG. 4 shows side by side the conventional power relay 100 and the power relay 10 of the embodiment of FIG. 1, which are identical in rated current and in rated control capacity and thus similar in use. As shown in FIG. 4, the input/output terminal tabs 1-1 to 1-4, 11' and 12' are arranged so that the terminal tabs are arranged along the front-rear direction Z1 and along the left fringe of a respective terminal-connection face 13. Accordingly, a width of each of the input/output terminal tabs 1-1 to 1-4 of the power relay 10 is smaller than that of the input/output terminal tabs 11' and 12' of the conventional power relay 100. As a result, it is able to decrease a dimension of a space in the front-rear direction Z1, which is required for arranging the input/output terminal tabs and connecting to the receptacles 31 of the electric cables. As a result, according to the embodiment of the present invention, the dimension of the power relay is able to be decreased in the front-rear direction Z1 if dimensions of other elements are also able to be decreased in the front-rear direction Z1.

REFERENCE NUMERALS

1-1 to 1-4: 1st to 4th input/output terminal tabs, 10: Power relay

100: Conventional power relay, 11: 1st input/output terminal element

12: 2nd input/output terminal element, 11': 1st input/output terminal tab

12': 2nd input/output terminal tab, 13: Terminal-connection face

14: Casing, 2-1 to 2-2: Control terminal tabs, 3-1 to 3-4, 3-1', 3-2': I/O electric cables

31: Receptacle, 32: Resin cover, 35-1 to 35-2: Control electric cable

4-1 to 4-2: U-shaped terminal member, 41: Stationary contact, 5: Movable terminal element

51: Movable contact, 6: Plunger, Z1: Front-rear direction

The invention claimed is:

1. A power relay having terminal tabs, comprising:

an on-off contact element having at least one movable contact and at least one stationary contact;

an on-off drive element configured to make the at least one movable contact come into contact with or separate from the at least one stationary contact;

at least two pairs of input/output terminal tabs electrically connected to at least one pair of input/output portions of the on-off contact element; and at least one pair of control terminal tabs electrically connected to control terminal portions of the on/off drive element, each of the input/output portions being electrically connected to two input/output terminal tabs of each pair of the input/output terminal tabs, the two input/output terminal tabs being arranged side-by-side in a thickness direction thereof and in vicinity with each other, and the input/output terminal tabs and the control terminal tabs having the same thickness as each other and the same width as each other, wherein the on-off drive element includes a conductive movable terminal element, the at least one movable contact includes two movable contacts disposed in the conductive movable terminal element, the at least two pairs of the input/output terminal tabs are electrically connected to each other when the at least one moveable contact is in contact with the at least one stationary contact, and the movable terminal element is formed as a horizontal plate extending in a front-rear direction so that the movable contacts are formed on the front and rear portions of the movable terminal element.

2. The power relay according to claim 1, wherein each of the input/output portions and the two input/output terminal tabs electrically connected thereto are made of a single U-shaped terminal member which is formed by bending a single metal piece.

3. The power relay according to claim 2, wherein a portion of the U-shaped terminal member forms the at least one stationary contact.

4. The power relay according to claim 1, wherein a rated energizing current is larger than 30 A, and each of the input/output terminal tabs has a thickness of 1 mm or less and a width of 7 mm or less.

5. The power relay according to claim 1, wherein each of the input/output portions and the two input/output terminal tabs electrically connected thereto are made of a single U-shaped terminal member which is formed by bending a single metal piece;

each of the U-shaped terminal members consists of a rectangular horizontal-plate portion, which forms a bottom portion of the U-shaped terminal member, and two vertical-plate portions, which are extended from right-hand-side and left-hand-side ends of the horizontal-plate portion to be elongated in vertical direction and which are arranged parallel with each other;

the bottom surface of the horizontal-plate portion forms the stationary contact, and the horizontal-plate and two vertical-plate portions of one of the U-shaped terminal members are arranged as aligned to corresponding one of the horizontal-plate and two vertical-plate portions of another one of the U-shaped terminal members.

6. The power relay according to claim 5, wherein the movable terminal element extends frontward and rearward from an actuation end of a reciprocating-motion element.

* * * * *